US005949018A

United States Patent [19]

Esker

[11] Patent Number: 5,949,018

[45] Date of Patent: Sep. 7, 1999

[54] WATER BLOCKED SHIELDED COAXIAL CABLE

[75] Inventor: David C. Esker, Conover, N.C.

[73] Assignee: CommScope, Inc. of North Carolina, Hickory, N.C.

[21] Appl. No.: 08/773,478

[22] Filed: Dec. 23, 1996

[51] Int. Cl.[6] ..... H01B 7/28

[52] U.S. Cl. ..... 174/23 R; 174/106 R; 174/121 A

[58] Field of Search ..... 174/23 R, 23 C, 174/106 R, 102 R, 103, 121 A

[56] References Cited

U.S. PATENT DOCUMENTS

| | | | |
|---|---|---|---|
| 3,340,353 | 9/1967 | Mildner | 174/106 R |
| 3,588,317 | 6/1971 | Hutchins, Jr. | 174/106 R X |
| 3,643,007 | 2/1972 | Roberts et al. | 174/106 R |
| 5,133,034 | 7/1992 | Arroyo et al. | 174/23 R X |
| 5,481,635 | 1/1996 | Arroyo et al. | 385/103 |
| 5,486,648 | 1/1996 | Chan et al. | 174/23 R |
| 5,796,042 | 8/1998 | Pope | 174/121 A X |

OTHER PUBLICATIONS

Announcement from Belden entitled Composite Braid: Metallic Wire and Water Expandable Yarn (Patent Pending), California Cable Association 1996 Western Show, Dec. 11–13, 1996 (trade show).

*Primary Examiner*—Hyung-Sub Sough
*Assistant Examiner*—Chau N. Nguyen
*Attorney, Agent, or Firm*—Alston & Bird LLP

[57] ABSTRACT

The present invention provides a fully water blocked coaxial cable. In one preferred embodiment, the cable includes at least one metallic inner conductor and a dielectric material surrounding the inner conductor or conductors. A first metallic shield tape surrounds the dielectric material and the conductor or conductors. A first braided metallic shield surrounds the first metallic shield tape, and a second metallic shield tape surrounds the first braided shield. A water swellable flooding material is disposed between the first and second metallic shield tapes. A second braided metallic shield surrounds the second metallic shield tape, and a jacket surrounds the second braided metallic shield. In one preferred form of the invention, the water swellable flooding material includes at least one water swellable strand disposed between the first and second metallic shield tapes. More particularly, the water swellable strand may include a yarn having a coating of a water swellable hydrophilic material.

16 Claims, 1 Drawing Sheet

WATER BLOCKED SHIELDED COAXIAL CABLE

FIELD OF THE INVENTION

This invention relates to coaxial cables, and more particularly to coaxial cables containing a water blocking material to prevent water migration.

It is sometimes desirable for cables to be designed to prevent water from penetrating into the cable in the event of a cut or breach in the jacket. Industry standard tests exist, such as Bellcore's specification GR-1398-CORE, wherein an open end of the cable is subjected to a predetermined water pressure for a predetermined amount of time. Cables that allow no water migration to a specified length when subjected to the test are deemed "water blocked."

The most common method of protecting a cable against water penetration is the use of flooding materials to fill the interstices of the cable. Synthetic polymers and petroleum based greases and oils are commonly used as flooding materials. Hydrophilic materials (also referred to as hygroscopic or water swellable materials) have also been used in cables for water blocking. These hydrophilic materials are initially dry to the touch, but turn to a gel-like consistency and swell considerably when exposed to moisture. One chemical family of such materials are polyacrylates.

Water swellable hygroscopic materials have been incorporated into cables in various ways. For example, a non-woven tape is available commercially which is impregnated with a water swellable polymer powder. The tape can be wrapped around the cable core beneath the cable jacket. Other applications have applied the water swellable material in powder form directly to the cable core prior to jacketing.

Certain coaxial cable constructions do not lend themselves well to the direct application of flooding materials in order to achieve water blocking. For example, a so-called "quad shield" design coaxial cable is produced by applying a metallic foil shield tape and a shield of braided metallic wires to an insulated conductor, then repeating with an additional pass of foil shield tape and braid. Four layers of shielding are created, hence the term "quad shield". While applying flooding materials over the final layer of braid is straightforward, applying flooding materials to the inner braid layer is troublesome and messy since the cable must be subjected to additional handling and processing when applying the subsequent shield layers and jacketing.

SUMMARY OF THE INVENTION

The present invention provides a fully water blocked coaxial cable. In one preferred embodiment, the present invention provides a fully water blocked quad shield coaxial cable.

A cable in accordance with one embodiment of the present invention comprises at least one metallic inner conductor and a dielectric material surrounding the inner conductor or conductors. A first metallic shield tape surrounds the dielectric material and the conductor or conductors. A first braided metallic shield surrounds the first metallic shield tape, and a second metallic shield tape surrounds the first braided shield. A water swellable flooding material is disposed between the first and second metallic shield tapes. A second braided metallic shield surrounds the second metallic shield tape, and a jacket surrounds the second braided metallic shield. In one preferred form of the invention, the water swellable flooding material comprises at least one water swellable strand disposed between the first and second metallic shield tapes. More particularly, the water swellable strand may comprise a yarn having a coating of a water swellable hydrophilic material. The water swellable strand or strands can be disposed between the first and second metallic shield tapes in various ways. They may extend alongside the metallic strands which form the first braided metallic shield and form a part of the braid itself. Another way is to position the water swellable strand or strands between the first metallic shield tape and the first braided shield. Still another way is to position the strands between the first braided metallic shield and the surrounding second metallic shield tape. It is also possible to apply the water swellable flooding material to the first braided metallic shield by coating or impregnation. Finally, it is possible to use a combination of two or more of the foregoing techniques.

The cable will typically also have a flooding material applied to the outer (second) braided shield. The flooding of the outer shield can be achieved by conventional methods or by any of the previously described techniques.

The present invention also provides a method of making a fully water blocked quad shield coaxial cable. The method according to one embodiment of the present invention comprises the steps of forming a dielectric material around at least one inner conductor, applying a first metallic shield tape around the dielectric material and the at least one inner conductor, and forming a first braided metallic shield around the first metallic shield tape, applying a second metallic shield tape around the first braided shield, providing a water swellable flooding material between the first and second metallic shield tapes, forming a second braided metallic shield around the second metallic shield tape, and forming a jacket surrounding the second braided metallic shield. The step of providing a water swellable flooding material may comprise directing at least one water swellable strand between the first and second metallic shield tapes.

BRIEF DESCRIPTION OF THE DRAWINGS

Some of the features and advantages of the invention having been stated, others will become apparent from the detailed description which follows, and from the accompanying drawings, in which—

DESCRIPTION OF ILLUSTRATED EMBODIMENTS

Figure 1:
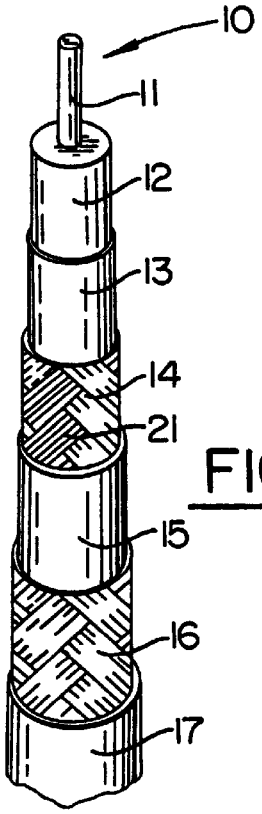
FIG. 1 is a perspective view showing a coaxial cable in accordance with a first embodiment of the invention.

Referring now to FIG. 1, the reference character 10 generally indicates a quad shield coaxial drop cable in accordance with the present invention. The cable 10 includes a metallic inner conductor 11, a dielectric 12 a metallic shield tape 13 surrounding the dielectric 12. The dielectric 12 is preferably a polyolefin dielectric such as a foamed polyethylene. The shield tape 13 surrounds the dielectric and is preferably heat sealed thereto, with the longitudinal edge portions of the tape overlapping and sealed together so that the tape completely surrounds the dielectric. The shield tape 13 preferably comprises an aluminum foil layer with a heat activatable adhesive layer on the inwardly facing surface thereof. By heating the cable core after application of the shield tape 13, the aluminum foil layer can be bonded to the dielectric 12.

A first braided shield 14 surrounds the shield tape 13. The braided shield 14 is produced by a conventional braiding machine and includes a plurality of metallic strands, with a first set of metallic strands being helically wound in one direction about the cable core, and with a second set of metallic strands being helically wound in the opposite direction and interwoven with the first set to form a braid. A second shielding tape 15 surrounds the first braided shield 14. The second shield tape may comprise an aluminum foil tape wrapped around the first braided shield with the longitudinal edges of the tape overlapping. A second metallic braid 16 surrounds the shield tape 15 and a polymeric outer jacket 17 surrounds the braid 16. The polymeric jacket 17 may be formed of a conventional extrudable polymer such as polyvinylchloride, a polyolefin, or a fluoropolymer. A conventional water blocking composition may be applied to the second braid 16 prior to application of the jacket 17. This prevents water penetration longitudinally along the cable between the jacket and the second shield tape 15.

To prevent water penetration along the interior shield, a water swellable flooding material is disposed between the inner shield tape 13 and the outer shield tape 15. In the embodiment shown in FIG. 1, the water swellable flooding material is in the form of one or more water swellable strands 21 located between the first and second shield tapes 13, 15. The water swellable strand may comprise a yarn or thread which has been coated with a water swellable hydrophilic material. Typically, the water swellable materials are available in powder form. They can be applied to a carrier, such as a yarn or strand, by dissolving or dispersing the powder in a suitable nonaqueous medium to form a solution or dispersion, and then coating or impregnating the thread or yarn with the solution or dispersion, and then drying the composition, leaving a coating of the water swellable powder. Various commercially available inorganic and organic hydrophilic water swellable materials are capable of use in the present invention. Examples of inorganic materials include, for example, absorbent clay and silica gels. Organic materials can include natural materials, such as agar, pectin, or guar gum as well as synthetic materials, such as synthetic hydrogel polymers. Synthetic hydrogel polymers are the preferred water swellable hydrophilic material for the present invention. Such hydrogel polymers include, for example, carboxymethylcellulose, alkali metal salts of polyacrylic acids, polyacrylamides, polyvinyl alcohol, ethylene maleic anhydride copolymers, polyvinyl ethers, hydroxypropyl cellulose, polymers and copolymers of vinyl sulfonic acid, polyacrylates, polyacrylamides, polyvinyl pyridine and the like. The hydrogel polymers are preferably lightly cross-linked to render the materials substantially water-insoluble. Suitable materials are available from various commercial vendors, such as Dow Chemical Company, Absorbent Technologies, and Stockhausen. Water swellable polymer powders are available from Absorbent Technologies under the trademark AQUAKEEP®. Examples of powders commercially available from Stockhausen include those designated CA800 and CA800HS. Typically, the hydrophilic hydrogel polymer material is capable of absorbing at least about 15 times its weight in water, and preferably is capable of absorbing at least about 25–50 times its weight.

In the embodiment shown in FIG. 1, yarns having a coating of the water swellable hydrophilic polymer material are incorporated into the braid itself along with the metallic strands forming the braid. This can be achieved by simply placing one or more bobbins of the water swellable yarn on selected spindles of the braiding machine in lieu of spools of metal wire. The water swellable strands or yarns are indicated in FIG. 1 by the reference character 21.

Figure 2:
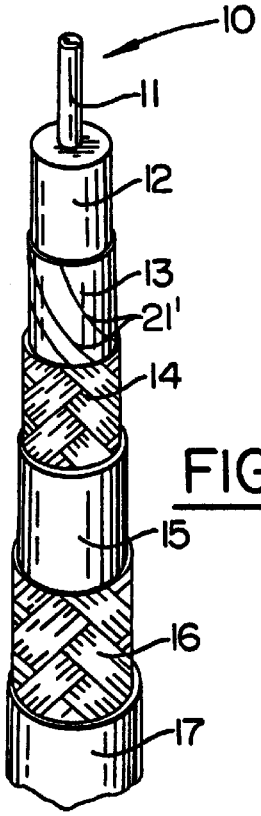
FIGS. 2–4 are views similar to FIG. 1 showing coaxial cables in accordance with second, third and fourth embodiments of the invention, respectively.
Figure 3:
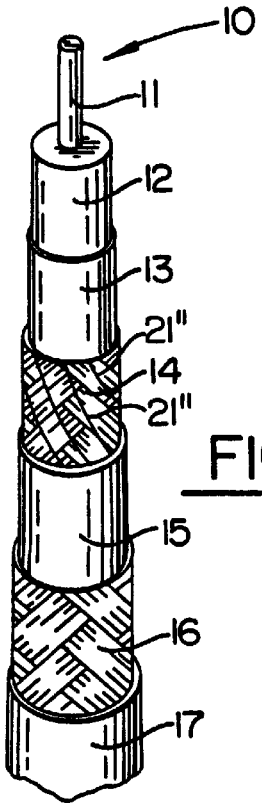
Figure 4:
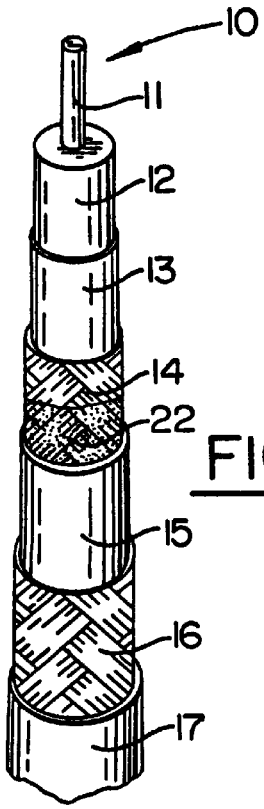

FIGS. 2 to 4 illustrate coaxial cables in accordance with alternate embodiments of the present invention. These alternate embodiments are quite similar to the construction previously described in connection with FIG. 1, except for the way that the water swellable flooding material is disposed between the first and second shield tapes. Therefore, to avoid repetitive description, elements in FIGS. 2 to 4 which correspond to those previously described in connection with FIG. 1 are identified with the same reference characters.

Referring now to FIG. 2, the cable shown in this figure differs from that of FIG. 1 only in that the water swellable strands or yarns are located between the inner shield tape 13 and the surrounding braided shield 14. The water swellable strands, indicated by the reference character 21', are shown as extending helically around the shield tape 13. The strands may be conveniently applied in this manner by advancing the cable core past a strand applying station before it enters the braiding machine. The strand applying station can include a bobbin of the yarn mounted to rotate about the advancing cable core. Alternatively, the strands 21' may simply be laid alongside the advancing core as it enters the braiding machine, in which case the strands will extend substantially longitudinally along the cable.

The cable shown in FIG. 3 is similar to that of FIG. 2, except that the water swellable strands, indicated by the reference character 21", are applied between the braid 14 and the surrounding shield tape 15. The strands may be disposed helically around the braided shield 14, or they may extend along the longitudinal direction.

Referring now to FIG. 4, in this embodiment, the water swellable flooding material is applied as a coating directly to the first braided shield 14. In this embodiment, the water swellable material is applied by passing the braided core through a dispersion, suspension or solution of the material in a suitable nonaqueous medium. The nonaqueous medium is then evaporated, leaving a coating 22 of the swellable polymer. The second layer of tape 15 and braid 16 is then applied to this coated, braided core. Nonaqueous suspensions of the water swellable polymer are commercially available from various sources, such as Fiberline for example.

The foregoing embodiments are to be considered illustrative rather than restrictive of the invention, and those modifications which come within the meaning and range of equivalence of the claims are to be included therein.

That which is claimed:

1. A cable comprising at least one metallic inner conductor, a dielectric material surrounding the at least one inner conductor, a first metallic shield tape surrounding the dielectric material and the at least one inner conductor, a first braided metallic shield surrounding said first metallic shield tape, a second metallic shield tape surrounding the first braided shield, a water swellable flooding material disposed between said first and second metallic shield tapes, a second braided metallic shield surrounding the second metallic shield tape, and a jacket surrounding the second braided metallic shield.

2. A cable according to claim 1, wherein said water swellable flooding material comprises at least one water swellable strand disposed between said first and second metallic shield tapes.

3. A cable according to claim 2, wherein said at least one water swellable strand comprises a yarn having a coating of a water swellable hydrophilic material.

4. A cable according to claim 2, wherein said first braided metallic shield comprises a plurality of metal strands and said at least one water swellable strand braided together.

5. A cable according to claim 2, wherein said at least one water swellable strand extends between said first braided metallic shield and the first metallic shield tape.

6. A cable according to claim 5, wherein said at least one water swellable strand extends helically around said first metallic shield tape.

7. A cable according to claim 6, wherein said at least one water swellable strand extends helically around said first braided metallic shield.

8. A cable according to claim 5, wherein said at least one water swellable strand also extends between said second metallic shield tape and the first braided metallic shield.

9. A cable according to claim 2, wherein said at least one water swellable strand extends between said second metallic shield tape and the first braided metallic shield.

10. A cable according to claim 1, wherein said water swellable flooding material comprises a coating of a water swellable hydrophilic polymer material applied to said first braided metallic shield.

11. A cable comprising at least one metallic inner conductor, a dielectric material surrounding the at least one inner conductor, a first metallic shield tape surrounding the dielectric material and the at least one inner conductor, a bonding layer bonding the first metallic shield tape to the surface of the dielectric material, a first braided metallic shield surrounding said first metallic shield tape, a second metallic shield tape surrounding the first braided shield, at least one water swellable strand disposed between said first and second metallic shield tapes, a second braided metallic shield surrounding the second metallic shield tape, and a jacket surrounding the second braided metallic shield.

12. A cable according to claim 11, wherein said at least one water swellable strand comprises at least one yarn having a coating of a water swellable hydrophilic polymer material.

13. A cable according to claim 11, additionally including a flooding material located between said jacket and said second metallic shield tape.

14. A cable according to claim 13, wherein said flooding material located between said jacket and said second metallic shield tape comprises at least one yarn having a coating of a water swellable hydrophilic polymer material.

15. A coaxial drop cable comprising a metallic inner conductor, a foam polymer dielectric material surrounding the inner conductor, a first metallic shield tape surrounding the dielectric material and the inner conductor, said first metallic shield tape comprising an aluminum foil layer and an adhesive bonding layer carried by the foil layer and bonding the foil layer to the surface of the dielectric material, a first braided metallic shield surrounding said first metallic shield tape, a second metallic shield tape surrounding the first braided shield, said second metallic shield tape comprising an aluminum foil layer, at least one water swellable strand disposed between said first and second metallic shield tapes, a second braided metallic shield surrounding the second metallic shielding tape, a jacket surrounding the second braided metallic shield, and a flooding material located between said jacket and said second metallic shield tape.

16. A coaxial cable comprising at least one metallic inner conductor, a dielectric material surrounding the at least one inner conductor, at least one foil-braid shield pair surrounding the dielectric material and the inner conductor, said foil-braid shield pair comprising an aluminum foil layer, a surrounding braid of metallic strands, and at least one water swellable strand extending alongside the metallic strands and forming a part of said braid.

* * * * *